United States Patent [19]

Thompson

[11] Patent Number: 4,622,257

[45] Date of Patent: Nov. 11, 1986

[54] NON-SKID FIBER/CEMENT TILE

[75] Inventor: Thomas L. Thompson, Balboa, Calif.

[73] Assignee: THOM-McI, Balboa, Calif.

[21] Appl. No.: 763,528

[22] Filed: Aug. 8, 1985

[51] Int. Cl.[4] ..... B32B 5/16; B32B 27/06; B32B 27/14

[52] U.S. Cl. ..... 428/143; 427/203; 427/220; 427/372.2; 427/407.1; 428/312.4; 428/317.9; 428/414; 428/423.1; 428/703

[58] Field of Search ..... 428/141, 143, 703, 317.9, 428/312.4, 414, 423.1; 427/203, 220, 407.1, 372.2, 410

[56] References Cited

U.S. PATENT DOCUMENTS

| | | | |
|---|---|---|---|
| 2,925,831 | 2/1960 | Welty et al. | 427/203 |
| 3,080,253 | 3/1983 | Dietz et al. | 427/203 |
| 4,336,293 | 6/1982 | Eiden | 428/143 |
| 4,344,804 | 8/1982 | Bijen et al. | 428/703 |
| 4,418,109 | 11/1983 | Miller et al. | 428/143 |

FOREIGN PATENT DOCUMENTS

| | | | |
|---|---|---|---|
| 1123774 | 9/1956 | France | 428/143 |
| 1560692 | 2/1980 | United Kingdom . | |
| 2037615 | 7/1980 | United Kingdom | 428/703 |

*Primary Examiner*—Paul J. Thibodeau
*Attorney, Agent, or Firm*—John D. Lister; Cornelius P. Quinn; Timothy R. Schulte

[57] ABSTRACT

A floor tile having a non-skid surface and a method of forming same that includes a base member formed from a fiber/cement mixture that is fireproof, waterproof and will not corrode, wherein at least one surface of the base member is coated with a first layer of bonding material that is impregnated with a selective size of grit particles, and is then covered with a second layer of bonding material to fixedly secure the grit particles within the first bonding layer, the grit particles having a size greater than the thickness of the first bonding layer so as to protrude therefrom.

16 Claims, 6 Drawing Figures

NON-SKID FIBER/CEMENT TILE

BACKGROUND OF THE INVENTION

1. Field of the Invention

This invention relates generally to floor tiles, and more particularly to a floor tile having a base member formed from a fiber/cement mixture on which a non-skid surface is applied which establishes a unique method of forming a completely non-skid tile structure that is superior in wear-resistance for those areas subjected to heavy foot traffic.

2. Description of the Prior Art

The invention as disclosed herein is especially suitable for replacing all known floor tiles and other covers for walking surfaces. There are many types and forms of floor tiles. Some are made of rubber, some of plastic, some of clay, etc. The majority of known tiles are made from materials which are unsuitable for use in or around damp and wet environments, as they do not provide non-skid surfaces. This is particularly true with various clay and ceramic tiles. Although some clay tiles are provided with rough surfaces which are designed to define non-skid surfaces, the use of such tiles is limited since their structural arrangements prevent them from being used under certain environmental conditions.

SUMMARY AND OBJECTS OF THE INVENTION

The present invention has for an important object to provide a new and unique, non-skid, floor tile and the method of forming such a floor tile to make it a highly marketable consumer product that is as economically feasible as that of most commercial tiles that do not provide non-skid surfaces.

Another object of the present invention is to provide a method of forming a non-skid-surfaced floor tile that comprises a base member consisting of fiber/cement that is coated with two layers of catalyzed resin, wherein the first layer is impregnated with a selective size of grit particles when in a wet state; and wherein a second coat is applied over the grit and the first layer to define a means for permanently locking the grit particles in the first coat while it secures them to the fiber/cement base.

Still another object of the present invention is to coat a fiber/cement base structure with a first layer of catalyzed resin and a second locking layer of polyurethane.

Yet another object of the present invention is to coat a fiber/cement base structure wherein the first and second layers consist of a polyurethane material.

A further object of the invention is to provide a non-skid-surfaced tile that has almost universal applications for any ground surface that would otherwise be slippery and dangerous to walk on or to operate a wheeled vehicle thereon.

A still further object of the invention is to provide a non-skid-surfaced tile member that is not affected by water, oil, gasoline, food, frost, and most liquid chemicals including solvents.

Still another object of the invention is to provide a non-skid tile of this character that can be manufactured inexpensively in any desired configuration and size from a 4"×4" to a 4'×8' sheet with a thickness generally between $\frac{1}{8}$" to 1". Thus, the finished tile member is readily affixed to a surface structure in any suitable manner, but preferably with a proper adhesive or mastic compound. Scews, nails, bolts and the like may also be employed, if required.

Yet a further object of the present invention is to provide a tile having the above characteristics that also is fireproof, will not corrode, and can be readily cleaned and kept sterile.

The characteristics and advantages of the invention are further sufficiently referred to in connection with the accompanying drawings, which represent several embodiments. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the drawings, which are for illustrative purposes only.

DESCRIPTION OF THE PREFERRED EMBODIMENT

Referring more particularly to FIGS. 1 through 4, there are shown enlarged, cross-sectional views representing a non-skid-surfaced tile having a base member 10 illustrated in such a manner as to indicate sequentially the several necessary steps for producing the non-skid-surfaced structure.

As previously mentioned heretofore, there are several areas of application for which the present invention is well suited. However, it will be readily apparent that, after understanding the end results of the present invention and its unique advantages, other uses for floorings, walkways, and even roadways, can be established.

Figure 1:
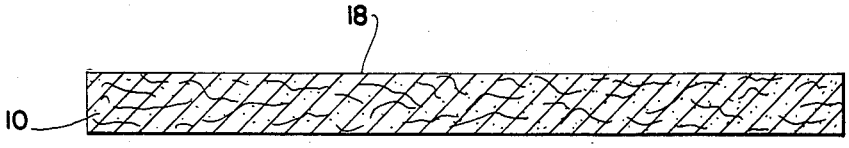
FIG. 1 is a cross-sectional view of the fiber/cement base member of the tile structure.
Figure 2:
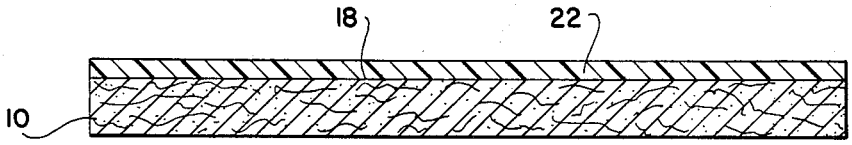
FIG. 2 is a cross-sectional view of the fiber/cement base member having the first bonding layer coated thereon.
Figure 3:
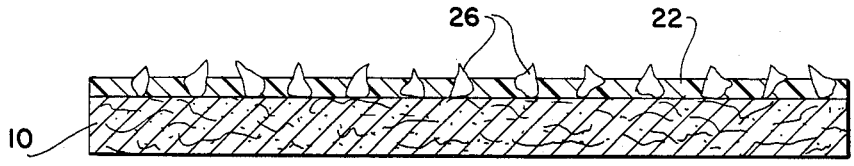
FIG. 3 is a view similar to FIG. 2 with grit particles impregnated in the first bonding layer.
Figure 4:
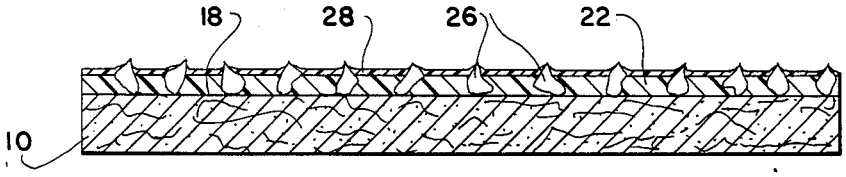
FIG. 4 is a cross-sectional view of the present invention in its completed form having the finished or second bonding layer applied to the surface of the first bonding layer.

FIG. 1 shows a fiber/cement base member 10 which is formed having a thickness preferably of between $\frac{1}{8}$" to 1".

The purpose of the particular method of forming the end product of the non-skid fiber/cement time is to provide a permanent but flexible bonding between the fiber/cement base member 10 and the non-skid elements thereof. Accordingly, the first embodiment as shown in FIGS. 1 through 4 comprises a fiber/cement base member having preferably a generally rectangular configuration, and having the approximate typical dimensions of 12"×12".

Once the base member 10 is formed and defined, a coat of catalyzed resin having a low viscosity is applied to the upper surface 18 of the base member 10. In other words, a catalyzed resin (preferably epoxy) must be applied in a thin liquid state, so as to penetrate within the surfaces 18, thus soaking into the fiber/cement compound and readily sealing the surface thereof.

The next step is to immediately apply a second coat of the same type of catalyzed resin. However, this second coat 22 is much thicker in viscosity and is formed having a thickness of between 10 to 30 mils. In order to aid in the bonding strength of layer 22, if required, there can be added thereto a sufficient amount of ground fiberglass (cabosil) which moreover provides a controlled viscosity of the resin. The second coat 22 is applied only to surface 18, and is then allowed to harden together with the first thin coat 16. Thus, a very strong bond is established between the second thick layer 22 and the saturated fiber/cement on surface 18. The time required for the hardening of the second coat 22 can vary, but generally it takes about one hour to dry hard under normal, ambient, room temperature—although the base member at this time can, if desired, be subjected to a predetermined controlled temperature, whereby the hardening time will be set under a selective temperature-controlled environment.

Layer of coat 22 is spread or roller over coat 18 and is applied having a thickness of berween 10 to 40 mils, and having a thick viscosity. The thickness of this coat is normally determined by the size and type of abrasive material that is combined therewith, the grit size being between No. 16 and No. 600. That is, while layer 22 is still very wet, and before it develops a skin-like surface, an overlay of very hard grit material 26 is evenly spread or disseminated over the wet layer of resin. It is preferred that grit 26 be formed of aluminum oxide. The thickness of layer 22 should be such as to allow the upper very-sharp edges of the aluminum-oxide, sand-like particles to extend above the surface of coat 22, with not more than half of each grit particle being submerged and held in place by the proper thickness of the resin material. It should be noted that other grit materials can also be used as an overlay under specific environmental conditions.

Figure 5:
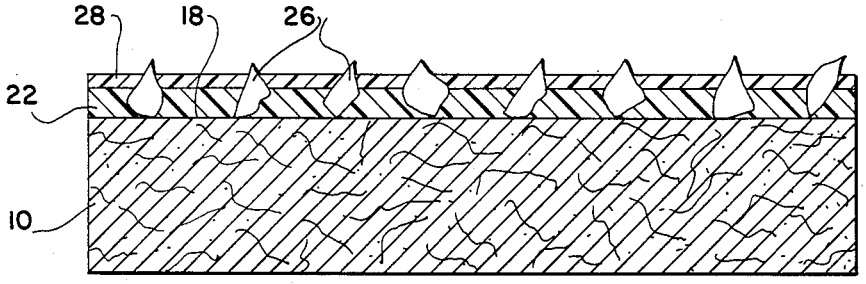
FIG. 5 is an enlarged, cross-sectional view similar to FIG. 4.

Due to extensive research, it was found that the surface tension of the first layer of resin sometimes prevents some of the grit particles from sinking completely into the layer far enough to be fixedly locked in place. Accordingly, a thin final layer 28 of a catalyzed resin is applied over the grit particles and resin layer 22, so as to establish a positive securing means to prevent any of the grit particles 26 from being dislodged from the structure. The finish layer 28 is thinly coated and has a viscosity of between 610 to 700 centipoises. This is clearly illustrated in the enlarged cross-sectional view of FIG. 5. The first layer of catalyzed resin 22 should have the proper thickness to cover only one-half to two-thirds of the grit particles, thus allowing the majority of the particles to settle and rest somewhat on surface 18 of the fiber/cement base member 10. The finish layer 28 is a much thinner coat which, when applied, covers layer 22 and leaves the remaining upper tip portion of each grit particle exposed to define the non-skid surface.

The fiber/cement base member 10 generally consists of 36% Portland cement; 30% crushed limestone; 20% Possolan volcanic ash; and 14% suitable fiber approximately $\frac{5}{8}''$ long. This particular composition is highly resistant to salt corrosion, and has excellent chemical and fire resistance.

It should be noted that, due to the varying consistency of the fiber/cement mixtures when forming the base structure 10, the porosity of its surface will also vary. Therefore, in some applications the low-viscosity catalyzed resin would not be required to seal the surface 18.

A second method of forming a non-skid fiber/cement tile is to apply, when necessary, a first thin coat of catalyzed resin to seal surface 18. This is followed by a second coat or layer of a catalyzed resin material, such as epoxy. Again, the second layer is preferably applied while the first thin coat is still wet, so that a more effective positive bonding is established between the second thick layer 22 and the base member 10.

While the second bonding layer 22 is still in its wet state, abrasive grit material is disseminated over this wet layer. Again, for the preferred end result, layer 22 should be of a thickness less than the overall size of the selected grit particles, which allows the upper portion of each particle to protrude through the surface of resin layer 22. The two bonding layers are then dried as herein described, whereby most of the particles are well secured in place. However, in this particular embodiment, the finish layer 28 that coats the catalyzed resin layer 22 is formed from a polyurethane material which provides the secondary locking effect necessary to prevent loose particles from dislodging from the base member 10, and which provides a means to prevent ultraviolet degradation of the catalyzed resin layer, particularly when the tile is employed outdoors.

A third embodiment is to replace the thick layer of catalyzed resin 22 with a layer of polyurethane material. That is, surface 18 is coated with a layer of polyurethane having a thickness of between 10 to 40 mils, and a thick viscosity of between 1100 and 1400 centipoises. Again, the thickness of this coat is determined by the size of the grit particles to be impregnated therein.

Another embodiment comprises the steps as previously described wherein layer 22 is formed from a polyurethane material as in the third embodiment, with the finish locking coat also being formed from a polyurethane material. Accordingly, the finish layer 28 is applied over the grit particles so as to establish a positive securing means to prevent any of the grit particles 26 from separating from the structure. Preferably, the finish layer 28 is thinly spread and has a viscosity of between 610 to 700 centipoises.

Figure 6:
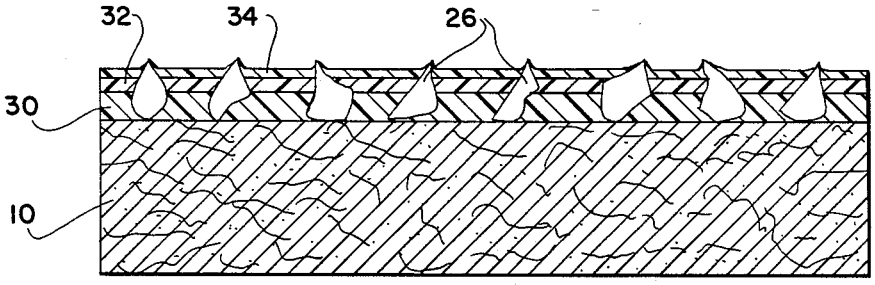
FIG. 6 is a cross-sectional view of an alternative arrangement of the invention.

A still further arrangement of the invention as shown in FIG. 6 provides the base member 10 with a first coat of catalyzed resin material, indicated at 30, wherein grit particles 26 are lodged and two succeeding layers of polyurethane are coated thereover. The first polyurethane layer 32 is applied after the resin layer 30 is dry, and then a second polyurethane layer 34 is applied over the first polyurethane layer 32. The second layer 34 of polyurethane is preferably applied after layer 32 is dry. However, the second polyurethane layer 34 may be applied when the first polyurethane layer 32 is in a tacky state.

In all of the above embodiments, the final layer can be selectively pigmented for color control.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A tile having a non-skid surface, comprising:

a base member formed from a fiber/cement mixture, said base member including an upper surface;

a bonding layer of material coated over said upper surface of said base member;

grit particles disseminated in said bonding layer wherein the size of said grit particles is greater than the thickness of said bonding layer such that a portion of said grit particles extend above the surface of said bonding layer; and a, finish layer of material coated over said bonding layer, so as to firmly secure said grit particles within said bonding layer, said finish layer having a thickness which allows a portion of said grit particles to extend above said finish layer.

2. A tile as recited in claim 1, wherein said bonding layer of material includes catalyzed resin, and wherein said finish layer of material includes polyurethane.

3. A tile as recited in claim 2, wherein said catalyzed resin is an epoxy.

4. A tile as recited in claim 1, wherein said bonding and finish layers of material include catalyzed resin.

5. A tile as recited in claim 1, wherein said bonding and finish layers of material include polyurethane.

6. A tile as recited in claim 1, wherein said base member has a thickness of between $\frac{1}{8}''$ to 1".

7. A tile as recited in claim 1, wherein said base member includes cement, crushed limestone, volcanic ash, and fibrous material.

8. A tile as recited in claim 2, wherein an additional layer of polyurethane is coated over said finish layer of polyurethane said additional layer having a thickness which allows a portion of said grit particles to extend above said additional layer.

9. A method of forming a non-skid tile, comprising the steps of:

coating at least one surface of a fiber/cement tile base member with a bonding layer of a predetermined thickness;

disseminating grit particles of a predetermined size within said bonding layer while said bonding layer is in a wet state, said grit particle size being greater than the thickness of said bonding layer;

drying said bonding layer thereby securing said grit particles to said tile base member;

coating said bonding layer of material with a finish layer of material said finish layer having a thickness to allow a portion of said grit particles to extend above said finish layer; and drying said finish layer of material so as to fixedly secure said grit particles within said bonding layer.

10. A method as recited in claim 9, wherein said bonding layer of material includes a catalyzed resin.

11. A method as recited in claim 10, wherein the aforesaid finish layer of material includes catalyzed resin.

12. A method as recited in claim 11, wherein said catalyzed resin is epoxy.

13. A method as recited in claim 10, wherein the aforesaid finish layer of material includes polyurethane.

14. A method as recited in claim 9, wherein said bonding layer and the aforesaid finish layer include polyurethane.

15. A method as recited in claim 9, wherein said fiber/cement tile base member includes cement, crushed limestone, volcanic ash, and fibrous material.

16. A method as recited in claim 15, wherein said finish layer of material has a viscosity of between 610 and 700 centipoises.

* * * * *